US007343911B2

(12) United States Patent
Crowley

(10) Patent No.: US 7,343,911 B2
(45) Date of Patent: Mar. 18, 2008

(54) TILE SHAPING BENCH

(76) Inventor: Aaron James Crowley, 590 SE. Mansfield, Sherwood, OR (US) 97140

( * ) Notice: Subject to any disclaimer, the term of this patent is extended or adjusted under 35 U.S.C. 154(b) by 1216 days.

(21) Appl. No.: 10/059,534

(22) Filed: Jan. 29, 2002

(65) Prior Publication Data

US 2003/0141646 A1 Jul. 31, 2003

(51) Int. Cl.
*B28D 7/04* (2006.01)
*B25B 1/14* (2006.01)
*B25B 5/12* (2006.01)

(52) U.S. Cl. ..... 125/35; 269/228

(58) Field of Classification Search ..... 451/365, 451/367, 378, 391; 269/3, 6, 139, 309, 312, 269/306, 317, 216
See application file for complete search history.

(56) References Cited

U.S. PATENT DOCUMENTS 2,565,925 A * 8/1951 Lombard et al. ..... 409/131
3,364,528 A * 1/1968 Fletcher ..... 24/67.1
4,735,393 A * 4/1988 Albee, Jr. ..... 248/452
5,494,553 A * 2/1996 Colucci ..... 156/580

OTHER PUBLICATIONS

U.S. Patent Specification 1418424, from the Patent Office of London, published Dec. 17, 1975, assignee: Dean Research Corporation.*

* cited by examiner

*Primary Examiner*—Joseph J. Hail, III
*Assistant Examiner*—Bryan Muller

(57) ABSTRACT

A tile shaping bench including an elongate guide extrusion having surfaces defining a channel adapted for receiving an edge of a tile, a first surface of the channel defined by a resilient surface, an elongate top extrusion positioned adjacent to the guide extension and including an elongate tile engaging surface, and an elongate clamp extrusion disposed below the top extrusion and including at least one operable clamp mechanism, the clamp mechanism operable to urge a tile against the elongate tile engaging surface of the top extrusion.

3 Claims, 4 Drawing Sheets

TILE SHAPING BENCH

BACKGROUND OF THE INVENTION

This application relates to the shaping and finishing of tiles used for countertops, and in particular to a bench that supports and clamps multiple tiles in alignment for a more precise finishing of their edges.

Granite and marble tiles are often placed onto countertops to provide an attractive and durable surface. Countertops finished with granites or marble are relatively expensive, and as a result, a high level of quality is demanded. One measure of the quality of the finished countertops is the consistency and precision of the exposed edges of the tiles. For example, where the edges of tiles are exposed along the edge of a countertop, the tiles are often reshaped from a square edge to a beveled or rounded edge. The edges are reshaped in order to provide a more attractive appearance a smoother feel to the edge. Where the tile edges are beveled or rounded, the quality of the finished job is strongly affected by how closely the tile's shaped edges match one another. This can be quite hard to achieve, in part because the tiles have different thicknesses, and known methods of supporting the tiles while finishing do not always accommodate differing tile thicknesses.

When shaping the edges of the tiles, a number of tiles are supported in a line on an underlying surface and clamped into place. All of the tiles are then finished simultaneously by a motorized grinding tool that rotates a shaping bit selected for the desired finished edge shape. However, when installed on the countertop, the upper surfaces of the tiles are aligned and not necessarily the bottom surfaces. As a result, if the tiles have different thicknesses, the shaped tile edges might not precisely align with one another, giving an irregular appearance to an exposed edge of the countertop. A need therefore remains for an improved apparatus and method for finishing the edges of tiles that provides a more precise and regular finish.

SUMMARY OF THE INVENTION

It is therefore an object of the invention to provide an improved method and apparatus for supporting tiles during the finishing of the tile edges.

Another object of the invention is to provide a bench that provides a faster set-up time.

It is another object of the invention to provide an improved apparatus for supporting tiles during the finishing of their edges.

It is yet another object of the invention to provide an apparatus and method for finishing the edges of tiles where the edges of adjacent tiles of different thicknesses can be more precisely aligned.

The present invention addresses these objects of the invention by providing an apparatus and method for finishing the edges of tiles wherein the finished edges of adjacent tiles can be more precisely aligned. The apparatus and method of the present invention utilize a novel approach to this long-standing problem. Instead of supporting the tiles on their bottom surface during the finishing of the edges as is currently done, the tiles are held with their upper edges aligned. In this way, the tiles are aligned during finishing in a manner that more closely approximates their positions when installed on the countertop, i.e. with their upper surfaces aligned. The apparatus of the present invention achieves the alignment of the upper surfaces of the tiles by providing a first clamping support of the tile near its center (relative to the edge being finished and the opposite edge), and by also providing a support for the opposite edge such that the upper surfaces of the of the tiles are held in alignment against an elongated surface. In this way, variations in the thicknesses of the tiles affect the alignment of the edge shaping of adjacent tiles to a lesser degree, and provide an improved finish to the countertop.

In one preferred embodiment, the present invention includes three elongate extrusions that are held in place by two end caps. Long threaded rods pass through the end caps and extrusions. Nuts on the threaded rods clamp the end caps and extrusions together and in place. Two legs are mounted in each end cap so support the end cap and extrusion assembly. The first clamp extrusion is generally T-shaped in cross section. On the T-shaped extrusion are mounted a plurality of clamps. Each clamp is positioned to bear against a tile and clamp it in place against a bottom surface of a second top extrusion. In a preferred embodiment, the clamps are quick release, lever actuated clamps to facilitate easy and fast mounting and dismounting of the tiles. A third guide extrusion is positioned to the rear of and spaced apart from the clamp extrusion. The guide extrusion includes a channel bounded on the bottom by a flat horizontal surface and on the top by a T-shaped channel into which is fitted an elongated resilient tile guide. One portion of the resilient guide is T-shaped to engage the corresponding T-shaped channel in the guide clamp. A second portion of the resilient guide includes a rounded portion. In order to place a tile into the assembly, a tile is placed with its rear edge placed between the clamp extrusion and the top extrusion and its finished surface downward. The tile is then slid rearward until the edge engages the channel formed by the lower surface of the guide extrusion and the rounded portion of the resilient guide. The resilient guide rounded edge accommodates variations in thickness of adjacent tiles, while at the same time permitting fast and easy insertion into the assembly. Finally, the clamp is closed securing the tile in the holder. Additional tiles are then placed into the assembly in a similar manner, and owing to the novel arrangement of the assembly, are in very accurate alignment with respect to their upper surfaces.

These and other objects and features of the invention will be explained in greater detail by reference to the following specification and the drawings.

DETAILED DESCRIPTION OF THE PREFERRED EMBODIMENTS

Figure 1:
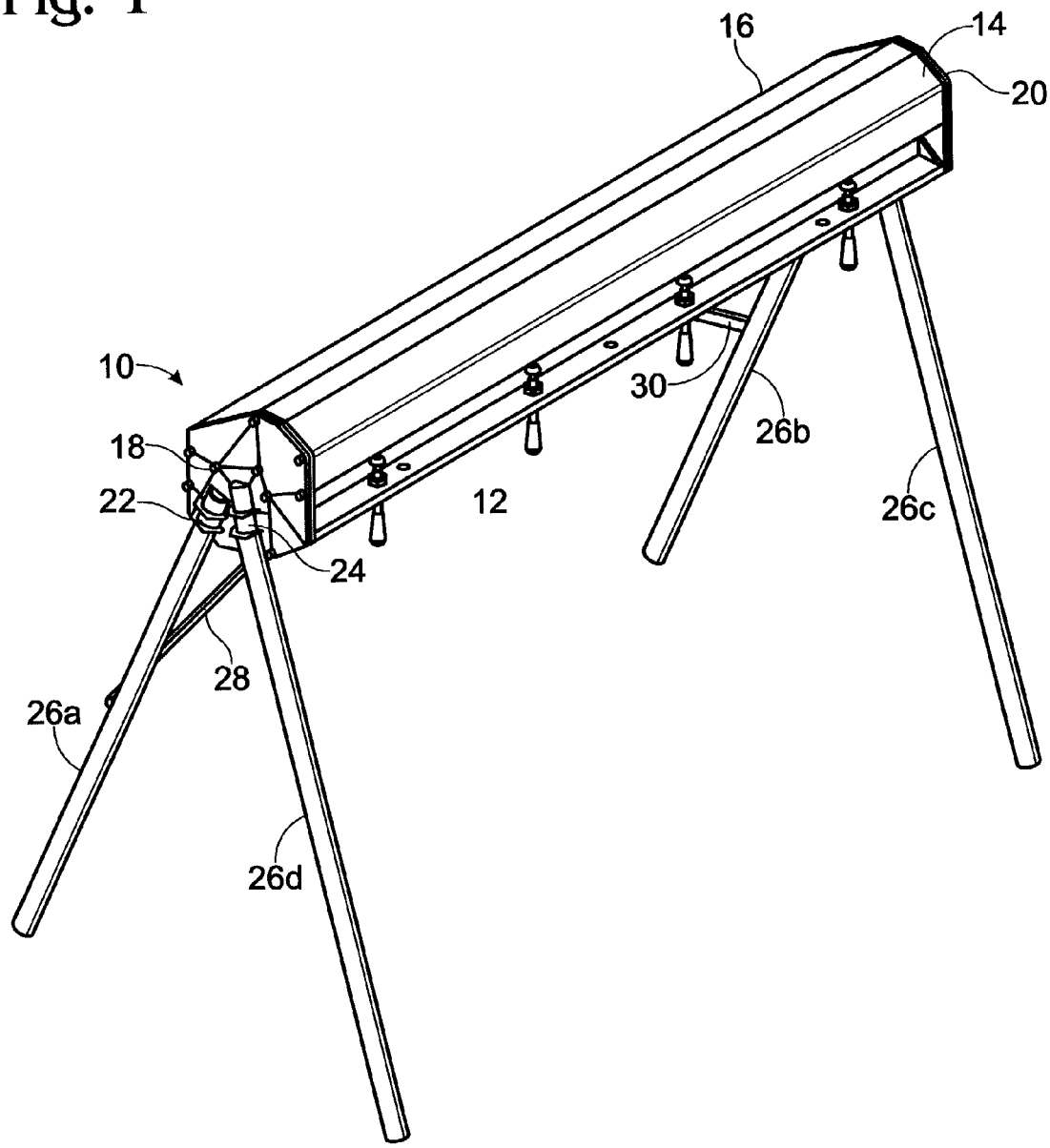
FIG. 1 is a perspective view of a preferred embodiment of the invention.
Figure 2:
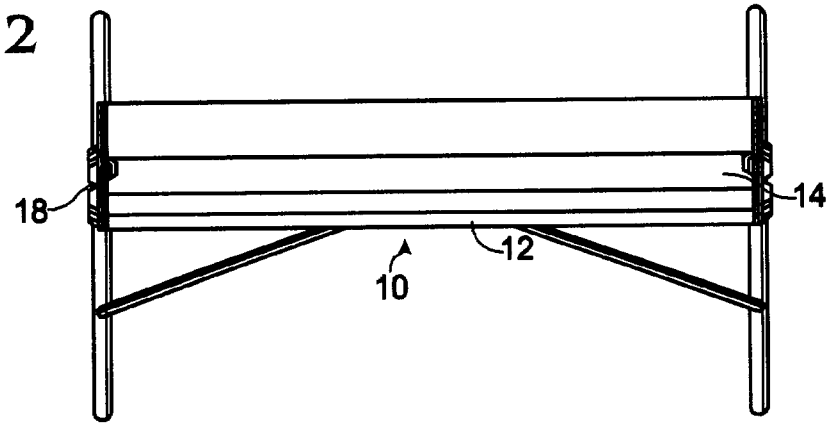
FIG. 2 is a top view of the preferred embodiment shown in FIG. 1.
Figure 3:
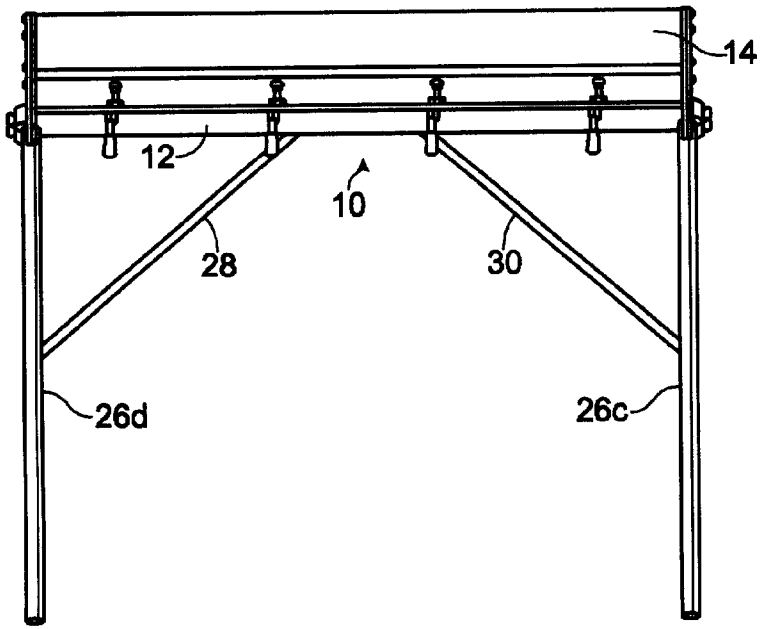
FIG. 3 is a rear elevational view of the embodiment shown in FIG. 1.
Figure 4:
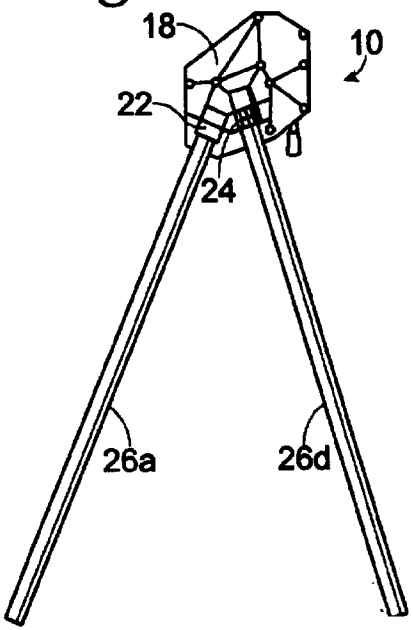
FIG. 4 is an end view of the embodiment shown in FIG. 1.

Referring now to FIGS. 1-3, a tile shaping bench according to a preferred embodiment of the invention is shown generally at 10. Bench 10 includes a clamp extrusion 12, a top extrusion 14, and a guide extrusion 16. The extrusions are mounted between end caps 18 and 20. Threaded rods (not shown) pass through the end caps 18 and 20 the various bosses 4 formed in extrusions 12, 14, and 16. Each end cap includes a pair of angled bosses 22 and 24. Each boss receives one of four legs 26*a-d* that together support the tile shaping bench. Referring again to FIG. 1, angled braces 28 and 30 extend between legs 26*a* and 26*b* and a vertical surface of guide extrusion 16 to stabilize the tile shaping bench. One advantage of the embodiment as described is that the assembly can be readily assembled and dissembled for transport. This provides the option of on-site finishing if desired, and permits craftsmen to include the assembly in their normal array of tools.

Figure 5:
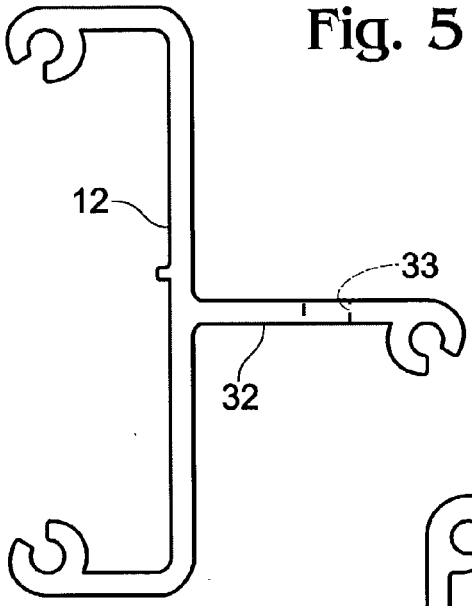
FIG. 5 is cross-sectional view of the clamping extrusion as utilized in the embodiment shown in FIG. 1.
Figure 6:
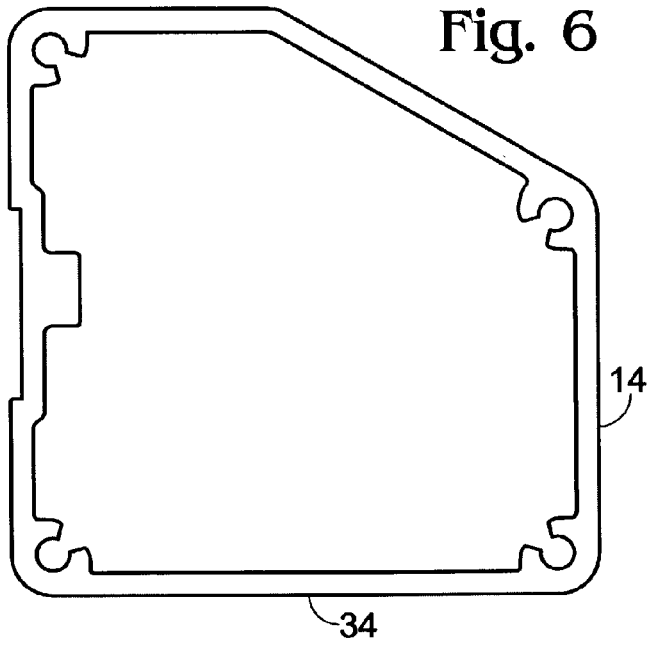
FIG. 6 is cross-sectional view of the top extrusion as utilized in the embodiment shown in FIG. 1.
Figure 7:
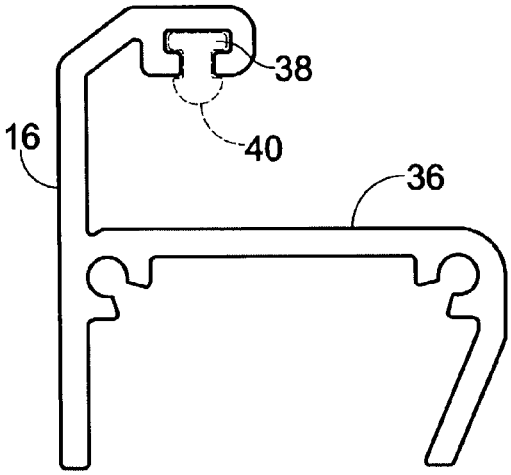
FIG. 7 is cross-sectional view of the guide extrusion as utilized in the embodiment shown in FIG. 1.
Figure 8:
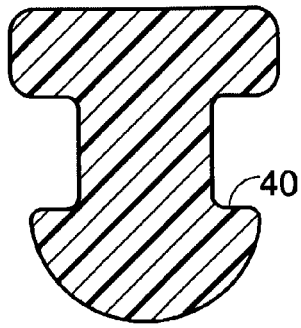
FIG. 8 is a cross-sectional view of the resilient tile guide that engages the guide extrusion shown in FIG. 7.

Referring now to FIG. 5, the clamp extrusion 12 is shown in detail in cross-section, and includes flange 32 which includes hole 33 into which an operable clamp is mounted as described in greater detail below. Referring to FIG. 6, top extrusion 14 is shown in detail, including surface 34 against which the finished surface 35 of a tile is held by the clamp. Referring to FIG. 7, the guide extrusion 16 is shown in cross-section, and includes surface 36 and channel 38. Channel 38 receives the resilient tile guide 40 (FIG. 8). Surface 36 receives the unfinished surface 37 of the tile. In the preferred embodiment, resilient tile guide 40 is made of a rubber such as neoprene, although any resilient material could be substituted. The extrusions 12, 14, and 16 are preferably formed of aluminum, although other materials having suitable strength and formability could be substituted if desired.

Figure 9:
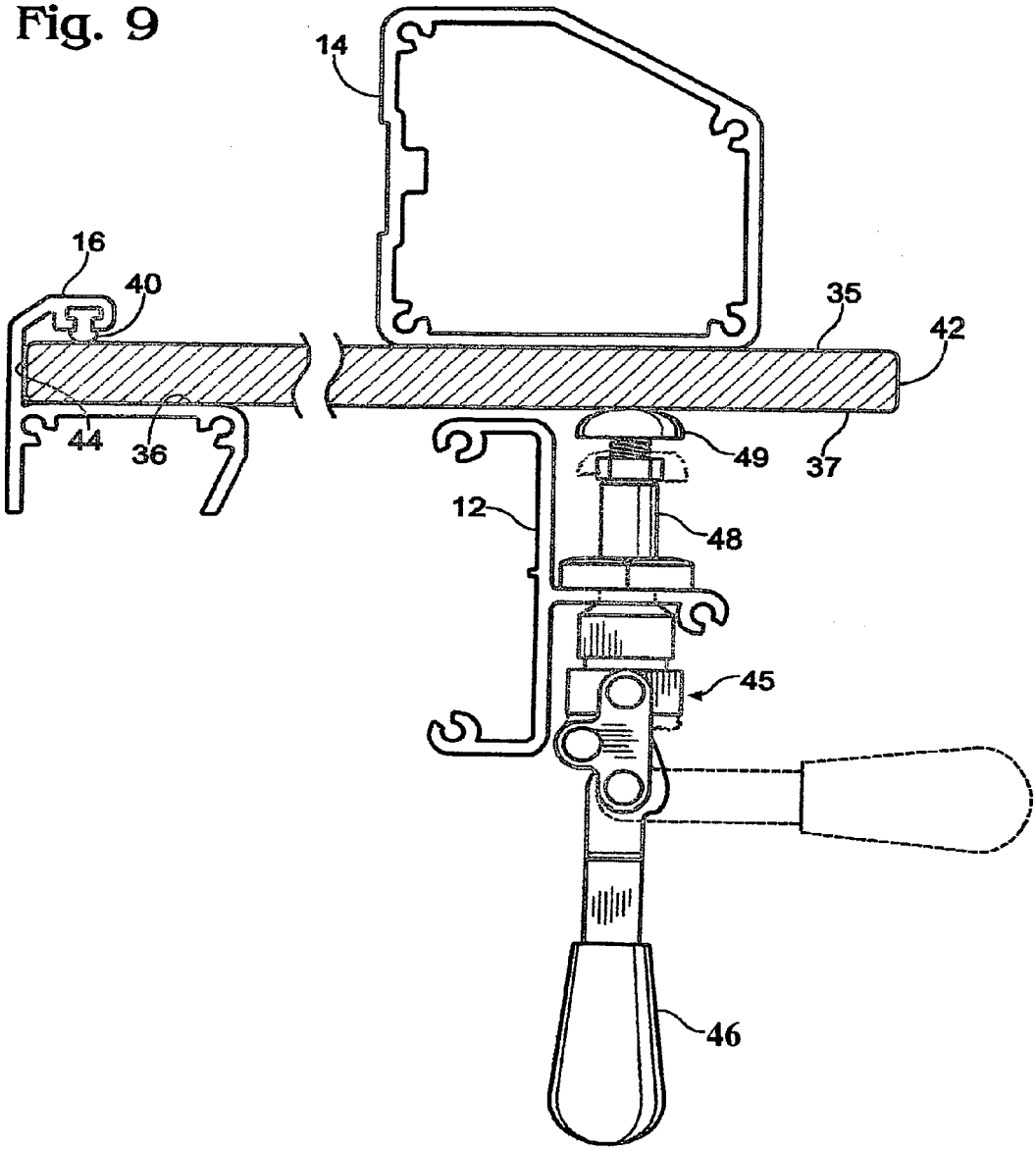
FIG. 9 is a cross-sectional view of the tile shaping bench and showing the relative positions of the clamp extrusion, top extrusion, and the guide extrusion, and showing a tile in place in the assembly.

Turning now to FIG. 9, a partial cutaway cross-sectional view of the invention is shown, including a tile 42 clamped into the assembly. To insert tile 42 into the assembly, the rear edge 44 of the tile 42 is slid between the clamp extrusion 12 and the top extrusion 14, and into the guide extrusion 16. The distance between surface 36 of the guide extrusion and resilient tile guide 40 is selected so that there is a slight interference fit that holds the tile snugly in place. In addition, the tile guide 40 is flexible and resilient, and will deform slightly to accommodate slightly thicker tiles within the normal range of variations in tile thickness. Once the rear edge of the tile 42 is seated in the guide extrusion, clamp 45 is operated by lever 46 to extend mandrel 48 into engagement with the lower surface 37 of tile 42. Mandrel 48 includes a threaded, rubber tipped spindle 49 that is adjustable in height to accommodate different thicknesses of tile. The retracted position of lever 46 is also shown in phantom in FIG. 9. Clamp 45 can be of any suitable design. That shown is a fully retractable locator manufactured by De Sta Co Industries, and sold as model no. 602.

Applicant has found that the invention as described provides numerous advantages over the prior art. In particular it permits the finishing of multiple tiles in a single operation and provides a more precise shaping of the edge than could be reliably achieved with known methods. Those of skill in the art will recognize that numerous changes in detail and materials could be made to the described embodiments without departing from the scope of the following claims.

What is claimed is:

1. A tile supporting and clamping assembly comprising:

an elongate guide extrusion having surfaces defining a channel adapted for receiving an edge of a tile, a first surface of the channel defined by a resilient surface;

an elongate top extrusion positioned adjacent to the guide extension and including an elongate tile engaging surface;

an elongate clamp extrusion disposed below the top extrusion and including at least one operable clamp mechanism, the clamp mechanism operable to urge a tile against the elongate tile engaging surface of the top extrusion;

a pair of end plates engaged with the respective ends of the guide extrusion, the top extrusion and the clamp extrusion; and, a plurality of threaded rods extending between the end plates and engaged with the guide extrusion, the top extrusion and the clamp extrusion.

2. A tile supporting and clamping assembly according to claim 1 wherein the at least one operable clamp mechanism includes an lever that is operable to move a portion of the clamp mechanism into clamping engagement with a surface of a tile disposed between the clamp extrusion and the top extrusion.

3. A tile supporting and clamping assembly according to claim 1 further comprising the guide extrusion, the top extrusion and the clamp extrusion each having at least one opening formed therein for receiving a threaded rod extending between the end plates.

* * * * *